US009888793B2

(12) United States Patent
Walker

(10) Patent No.: US 9,888,793 B2
(45) Date of Patent: Feb. 13, 2018

(54) TRAVEL PILLOW FOR SLEEPING IN A VERTICAL OR NEAR-VERTICAL RECLINED POSITION

(71) Applicant: Cedric Thelonious Macillian Walker, San Francisco, CA (US)

(72) Inventor: Cedric Thelonious Macillian Walker, San Francisco, CA (US)

( * ) Notice: Subject to any disclaimer, the term of this patent is extended or adjusted under 35 U.S.C. 154(b) by 0 days.

(21) Appl. No.: 14/811,564

(22) Filed: Jul. 28, 2015

(65) Prior Publication Data

US 2015/0327698 A1 Nov. 19, 2015

Related U.S. Application Data

(63) Continuation of application No. 13/506,125, filed on Mar. 29, 2012, now Pat. No. 9,101,223.

(51) Int. Cl.

| | |
|---|---|
| ***A47C 20/00*** | (2006.01) |
| ***A47G 9/10*** | (2006.01) |
| ***A47C 16/00*** | (2006.01) |
| ***A47C 7/38*** | (2006.01) |
| *A47C 21/02* | (2006.01) |

(52) U.S. Cl.

CPC ..... *A47G 9/1081* (2013.01); *A47C 7/383* (2013.01); *A47C 16/00* (2013.01); *A47G 9/1027* (2013.01); *A47C 21/026* (2013.01); *A47G 9/1009* (2013.01)

(58) Field of Classification Search

CPC .. A47G 9/1081; A47G 9/1027; A47G 9/1009; A47G 9/1072; A47G 9/109; A47C 7/383; A47C 7/386; A47C 7/38; A47C 16/00; A47C 21/026

See application file for complete search history.

(56) References Cited

U.S. PATENT DOCUMENTS 2,172,797 A * 9/1939 Lewallen ..... A47C 1/10 297/392
2,336,707 A * 12/1943 Thompson ..... A47C 7/383 5/636
2,973,030 A * 2/1961 Matthewson ..... A61F 5/055 128/DIG. 23
3,283,344 A * 11/1966 Blanchard ..... A47G 9/1009 2/174
4,161,946 A * 7/1979 Zuesse ..... A61F 5/055 128/DIG. 20

(Continued)

*Primary Examiner* — David E Sosnowski
*Assistant Examiner* — Morgan McClure
(74) *Attorney, Agent, or Firm* — Fenwick & West LLP

(57) ABSTRACT

The present invention is directed towards a travel pillow for sleeping in a vertical or near-vertical reclined position. When sleeping in these positions, gravity tends to pull the head forward of the shoulders causing it to droop. The current state of the art travel pillow does not provide a support means to counter this forward drooping tendency. Moreover, its rear support displaces the cervical spine forward, further increasing the tendency for the head to slump forward. The present invention holds a resting head in an upright and stable position to prevent forward head drooping and does so without forwardly displaying the cervical spine. The five novel elements of the present invention are integrally configured to maintain a healthy alignment between the occipital bone of the head, the cervical spine of the neck, and the thoracic spine of the upper back.

21 Claims, 8 Drawing Sheets

(56) References Cited

U.S. PATENT DOCUMENTS 4,232,663 A * 11/1980 Newton ..... A61F 5/055 128/DIG. 23
4,285,081 A * 8/1981 Price ..... A47C 7/383 297/391
4,617,691 A * 10/1986 Monti ..... A47C 7/383 128/DIG. 23
4,710,991 A * 12/1987 Wilmore ..... A61G 13/12 482/142
5,029,577 A * 7/1991 Sarkozi ..... A61F 5/055 602/18
5,060,637 A * 10/1991 Schmid ..... A61F 5/055 128/DIG. 23
5,303,890 A * 4/1994 Carruth ..... A47C 20/026 248/118
5,860,177 A * 1/1999 Jung ..... A47C 7/383 5/630
6,098,220 A * 8/2000 Momma ..... A47G 9/1009 5/636
6,122,784 A * 9/2000 Hurwitz ..... A47C 7/383 5/636
6,231,535 B1 * 5/2001 Mainiero ..... A47C 7/383 5/636
6,289,538 B1 * 9/2001 Fidge ..... A47C 7/383 297/393
6,625,829 B2 * 9/2003 Zell ..... A47C 7/383 128/DIG. 23
6,641,221 B1 * 11/2003 Kastlunger ..... A47C 7/383 297/392
6,860,563 B1 * 3/2005 Semsch ..... B60N 2/4882 297/220
7,213,883 B2 * 5/2007 Charnitski ..... B60N 2/4882 297/391
7,316,451 B2 * 1/2008 Balensiefer ..... A42B 3/00 297/216.11
D619,402 S * 7/2010 Sternlight ..... D6/601
8,783,776 B1 * 7/2014 Perkins ..... A47D 15/00 297/219.12
8,898,840 B1 * 12/2014 Majette ..... A47C 7/383 297/393
2005/0173962 A1 * 8/2005 Stein ..... A47C 7/383 297/397
2007/0209115 A1 * 9/2007 Carroll ..... A47C 7/383 5/636
2007/0256692 A1 * 11/2007 Pearson ..... A47C 7/383 128/845
2008/0271249 A1 * 11/2008 Deetsch ..... A47C 16/00 5/640
2009/0206646 A1 * 8/2009 Mittelstadt ..... A47C 7/383 297/397
2010/0205744 A1 * 8/2010 Edwards ..... A47C 7/383 5/644
2011/0225736 A1 * 9/2011 Schwingendorf ..... A61F 5/3707 5/652
2012/0011655 A1 * 1/2012 Rojas ..... A47C 7/383 5/636
2012/0139321 A1 * 6/2012 Wu ..... A47C 7/38 297/391
2013/0061856 A1 * 3/2013 Khademi ..... A61G 15/00 128/845
2013/0219624 A1 * 8/2013 Soffer ..... A45F 4/02 5/636
2013/0232693 A1 * 9/2013 Myers ..... A47C 7/383 5/636
2013/0232694 A1 * 9/2013 Ross ..... A47G 9/1009 5/639
2013/0254998 A1 * 10/2013 Walker ..... A47G 9/1081 5/637
2013/0312192 A1 * 11/2013 Lee ..... A47G 9/007 5/639
2014/0007351 A1 * 1/2014 Cohen ..... A47G 9/10 5/639
2014/0130261 A1 * 5/2014 Gumbrecht ..... A47C 7/383 5/644
2014/0173828 A1 * 6/2014 Wallace ..... A47C 7/38 5/636
2014/0259424 A1 * 9/2014 Higa ..... A47C 7/383 5/644
2014/0310877 A1 * 10/2014 Sternlight ..... A47G 9/10 5/639
2015/0020314 A1 * 1/2015 Garcia ..... B60N 2/4879 5/636
2015/0059098 A1 * 3/2015 Jung ..... A47C 7/383 5/636
2015/0274044 A1 * 10/2015 Kreppein ..... A47G 9/1081 5/636

* cited by examiner

TRAVEL PILLOW FOR SLEEPING IN A VERTICAL OR NEAR-VERTICAL RECLINED POSITION

CROSS REFERENCE TO RELATED APPLICATION

This application is a continuation of U.S. patent application Ser. No. 13/506,125, filed on Mar. 29, 2012, the contents of which are incorporated by reference herein in its entirety.

BACKGROUND

A disadvantage of traveling by airline, train, bus or automobile is the inability to stabilize the head while sleeping in an upright or near upright position. In the past, passengers of common carriers, especially airline passengers, could recline their headrest-equipped seats to a point where gravity worked to pull the head back towards the headrest. The only impediment to getting a restful sleep during that era, with respect to movement of the head, was gravity induced side-to-side or lateral movement of the head due to inadequate lateral support. A state of the art solution introduced in the early 1980's and which is still in use today to address this problem is the horseshoe or U-shape inflatable and non-inflatable pillow, U.S. Pat. No. 4,285,081. However, it was not the first solution introduced to the arts to address the problem, U.S. Pat. No. 4,161,946, U.S. Pat. No. 4,183,583, and U.S. Pat. No. 4,232,663 were predecessors but the U-shape pillow was the most practical during this time to address the issue of lateral head movement while sleeping. The U-shape pillow design basically consists of a left lateral pillow section, right lateral pillow section and rear pillow section. The lateral pillow sections were designed to provide lateral support to the head while sleeping in a reclined position. However, this U-shape design is not without disadvantage. The rear pillow section of the state of the art design fits behind the neck along the cervical vertebrae just below the occipital bone of the head. With most body types, the rear pillow section, when filled with air or filler material, tends to extend beyond the occipital bone of the head and the dorsal of the scapula (i.e., shoulder blade). In the reclined position, the rear pillow section generally fills the void between the back of the neck and the backrest and headrest of the reclined seat. Unfortunately because of the inferior design of this rear pillow section, the neck is pushed forward away from the backrest and headrest creating an unnatural curvature in the cervical vertebrae and thereby forwardly displacing the head from the headrest. This unnatural curvature is exacerbated as the reclined position increases. This is because as the head moves farther aft out of the vertical plane, the impact of gravity will increase the force acting on the displaced head pulling it towards the headrest and thus increasing the unnatural curvature of the cervical vertebrae and discomfort in the neck. This interaction does not allow the thoracic vertebrae of the back, the cervical vertebrae of the neck, and the occipital bone of the head to rest in their natural curvature state along the backrest and headrest of the seat. The discomfort felt at the back of the neck, caused by the inferior designed rear pillow section, can be reduced by decreasing the recline-angle, but this reveals yet another problem in the current state of the art U-shape travel pillow that must be addressed and will be introduced in the following paragraph.

The transportation industry, especially the common airline carriers, are under economic pressure to increase revenue by adding more seats to their aircraft fleet to transport more passengers without increase in overall size of their aircraft to accommodate these additional seats. The result has been less room between seats, which translates to a reduction in how far seats can be reclined without encroaching on the leg and personal space of the persons sitting behind. Moreover, the recline-angle is also limited by the viewing angle restrictions for multimedia entertainment systems which are now prominently located in the rear of most seat headrests for servicing the passenger sitting behind. Too high a recline-angle can hinder the ability of the passengers, sitting behind, to view and interface with these multimedia systems. This reduction in seat recline-angle has drastically changed how gravity influences the motion of the human head while sleeping. The problem, once limited to only lateral motion of the head, now has the added dimension of forward motion or drooping of the head. Because travelers are now forced to sleep in a more upright position, than just two decades ago, the probability of forward head movement or drooping has increased. During slight disruptions in momentum of the transport vehicle and/or when unexpected movement of the sleeper occurs, gravity may, because of the reduced recline-angle, pull the head forward causing the sleeper to wake suddenly. It should be stated that when sleeping in a vertical or near-vertical reclined position, the head will naturally droop forward of the shoulder to rest. This natural tendency is not in itself a negative as long as a sleeping pillow supports and maintains the forwardly resting head in, at minimum, a near-vertical position and deters forward motion by stabilizing the head while at rest. The volume of the conventional U-shape pillow is mostly concentrated posteriorly to and laterally to the neck, which makes it ineffectual in supporting and stabilizing a forwardly resting head. When using the current state of the art U-shape travel pillow, this tendency is even more probable because of the more forward position of the head relative to the seat headrest because of the innate forward displacement of the neck and cervical vertebrae caused by the rear pillow section.

An ad hoc solution for remedying this problem would be to reduce the air pressure in the rear pillow section, thereby reducing the overall volume of the rear support section. However, since the inflatable state of the art U-shape design employs a single inflatable bladder or single chamber design, the user cannot adjust the pressure in rear pillow section without affecting the pressure in the lateral pillow sections. To do so would mean a reduction in chamber pressure in the lateral pillow sections making them less supportive. This limitation prevents the user from adjusting the volume or thickness of the rear pillow section to maintain the natural curvature of the user's cervical vertebrae while resting on a headrest equipped seat. For the non-inflatable design, the filler material can be removed from the rear section allowing it to be compressed. However, this approach fundamentally changes the U-shape pillow's design and thus moves into the domain of new matter.

Additionally, the current state of the art U-shape pillow tends to shift position when in use. When sleeping in a vertical or near-vertical reclined position, the head will naturally tilt forward of the shoulder line while at rest.

This creates forces and moments that act forward of the shoulder line requiring the rear pillow section of the current state of the art to carry the force required to counteract and stabilizes these forwardly acting forces and moments. Moreover, because of the posterior position of the pillow's rear section around the neck, the pillow's rear section pulls the neck and head forward away from the headrest and in the process further increases the tendency for forward head drooping, illustrating yet another deficiency in the current state of the art design. Strong neck muscles could resist this forward tendency, but it would require neck muscles to not be at rest, which defeats the purpose of a restful sleep.

Sleepers will sometimes reposition themselves while sleeping causing the current state of the art travel pillow to sometimes slide upward, pivot along, and/or rotate around the sleeper's neck and cervical vertebrae. These undesired motions are caused when the sleeper's resting head creates forces and moments acting on the current state of the art travel pillow. The inside surface that comes into contact with the neck and lower surface that rests on shoulders cannot produce the frictional resistance required to prevent slippage because of the inherent design limitations of the current state of the art.

Lastly, it should be noted that the current state of the art U-shape pillow also does not provide a means for preventing forward head drooping. Short of reclining the seats more, which is no longer an option, there is currently no viable solution for preventing the head from moving forward while sleeping in vertical and near-vertical reclined position, provide optimized lateral support, prevent movement of the sleeping pillow while in operative engagement and maintain proper curvature of the cervical vertebrae. These added challenges must be addressed in a single integrated solution in the next generation of travel pillow if sleepers are to achieve a comfortable sleep while being transported by a common or private carrier.

The need of common airline carriers to add more seats to their aircraft and improve the "travel experience" by installing personal multimedia systems into the headrest of their seats has further reduced how far a typical seat can be reclined and ironically may have compromised the passenger's overall "travel experience" by making it more difficult to sleep because the traveler is now asked to sleep in a more upright position than just a few years ago. It should be noted that common carriers, especially the airlines, have made the effort to make seats more comfortable by providing a seat that provides a means for lateral support while sleeping. Unfortunately, these designs don't provide enough lateral support to prevent lateral movement of the head while sleeping and they do not address the issue of forward head movement. Moreover, in most cases, when sitting in a headrest equipped seat, the rear pillow section of the current state of the art U-shape pillow is a redundant component since the purpose of the headrest is to support the head. As already mentioned, in most cases, the rear pillow section tends to forwardly displace the neck and head hindering the user's ability to comfortably position their head against the headrest.

The performance disadvantages associated with the current state of the art U-shape pillow with respect to the changes in transportation system are as followed:

A disadvantage of the current state of the art U-shape pillow is the absence of a means for preventing forward drooping of head while sleeping in a vertical or near vertical reclined position.

Another disadvantage of the current state of the art U-shape pillow is the size and shape of its rear pillow section, particularly its depth and/or thickness; unfortunately this inferior design pushes the cervical vertebrae forward which increases the tendency for undesired forward drooping of the head and causes an unnatural and uncomfortable curvature in the cervical vertebrae while sleeping in a vertical or near vertical position.

Yet another disadvantage of the current state of the art U-shape pillow is the posterior position of its rear pillow section relative to the cervical vertebrae; when forces and moments from a resting head pull the current state of the art forward on the shoulders, the rear pillow section is forced forward against the cervical vertebrae thereby pulling it forward as well.

An additional disadvantage of the current state of the art U-shape pillow is its upper surface which directly/physically supports the head is not optimally angled to maximize the amount of upper surface area providing direct support to the head while sleeping in the vertical or near-vertical position.

Still an additional disadvantage of the current state of the art U-shape pillow is that the majority of its structure is not forward of the shoulder line but is instead located at the lateral and posterior position relative to the head and therefore is not oriented to adequately support a naturally forward tilting and resting head.

Still yet an additional disadvantage of the current state of the art U-shape pillow is it does not provide frontal support to arrest forward motion of a resting head in a vertical or near-vertical position.

A further disadvantage of the current state of the art U-shape pillow is it does not provide adequate lateral support forward of the shoulder line to arrest lateral and combined lateral-forward motions of a resting head in a vertical or near-vertical position.

Still a further disadvantage of the current state of the art U-shape pillow is different shoulder slopes will affect the angle and position at which the right and left pillow sections will provide support to the head.

Still yet a further disadvantage of the current state of the art U-shape pillow is there is no mechanism for deterring undesired movement around the neck and on the shoulders while sleeping in the vertical or near-vertical position as the sleeper shifts position.

These challenges can be overcome if a means for the traveler were provided that prevents forward movement of the head while sleeping, secures and stabilizes the head laterally while sleeping, does not compromise the natural curvature of cervical vertebrae, allows the head to rests naturally on the headrest of a seat, and does not reorient itself with respect to the sleeper's neck and shoulders as the sleeper adjusts his or her body while sleeping.

A LIST OF THE PRIOR ART

Innovations for sleeping pillows or head supports have been introduced in the prior art. This section will present these innovations.

A FIRST EXAMPLE, U.S. Pat. No. 4,161,946 to Zuesse teaches a support for maintaining the head in an upright position, as, for example, while resting or sleeping upright in a seat with a backrest. The support includes a forehead-engagement means to resist forward movement of the head. Forehead pressure against this means is transmitted to a nape-of-the-neck-engagement means, which is thereby pressed inwardly upon the rear of the neck. This pressure is then further transmitted by way of a chest-engagement means inwardly upon the sternum. Since the nape of the neck cannot move forward, and the sternum cannot move inward, falling forward of the forehead is precluded. Various ancillary support means can be added to supplement the basic head support. Thus, in some embodiments, the nape-engagement means is extended upwardly to provide an occipital support section, which engages the rear of the head and is extended downwardly to form a posterior support section for engaging the upper rear portion of the wearer's back. A shoulder-engaging frame fits across the wearer's shoulders and connects to the posterior support, in one embodiment, lateral supports extend from the shoulder-engaging frame to engage the sides of the wearer's head, and a chin support rises from the chest-engagement means. The complete support can be formed of rigid sections coupled together, or it can be formed of flexible material having an integral air chamber to provide a semi-rigid support. All versions of this head support depend on the basic principle of resisting forward movement of the head by the forehead-engagement means or headband transmitting this pressure to the nape and to the sternum, neither of which moves.

A SECOND EXAMPLE, U.S. Pat. No. 4,183,583 to Zuesse teaches a support for maintaining the head in an upright position while the seat-occupant is seated in a reclining seat. One part of the support is a forehead-engagement means to resist forward movement of the head. Forehead pressure against this means is transmitted by connecting means to a back-plate positioned between the back of the seat-occupant and the back-rest of the seat. With the seat-back-rest partially backward-inclined, and the forehead inclined slightly forward to rest forward against the forehead-engagement means, there is a tendency for the back-plate to rotate forward at the top and backward at the bottom. At the top, its resisted by the seat-occupant's back, resting backward against the back-plate; at the bottom, this rotational tendency is resisted by the seat-back-rest. The back-plate, thus sandwiched between the seat-occupant and the seat, maintains the forehead-engagement means in position to resist the forward-pressure of the resting forehead, so that the forehead is prevented from falling forward and downward toward the chest; in other words, the head is thus supported. Ancillary support means can be added to supplement the basic head-support above-described. Thus, for instance, there may be lateral-support means engaging the shoulders as part of the connecting means or back-plate, to resist lateral movement of the sleeping or resting head in the event that the seat-occupant (for example) is in transit aboard a vehicle which sways from side to side thus tossing the head left and right. All versions of this head-support depend upon the basic principle of preventing forward-falling of the forehead by transmitting this forward pressure via the connecting means to the back-plate sandwiched between the seat-occupant's back and the seat-back-rest.

A THIRD EXAMPLE, U.S. Pat. No. 4,232,663 to Newton teaches a cervical collar which is made of a pad of resilient foam material with a scalloped depressed area at the middle of the inside surface of the collar whereby a user's chin is supported in the depression and pressure on a user's throat area is relieved by the reduced thickness provided by the depression.

A FOURTH EXAMPLE, U.S. Pat. No. 4,285,081 to Price teaches a portable device for recumbency of the head and neck providing support for the same while travelling or in other situations where discomfort arises from lack of adequate support. The device is provided with a surface having a generally concave shape with respect to a vertical axis of curvature corresponding approximately to the central vertebral axis of the neck. The concave shape is fashioned so that it has symmetrical left and right halves, opposing areas of which are designed to exert gentle pressure in the vicinity of the mastoid processes of the head, a region near the base of the head, and located at the sides thereof almost at the rear. There are two embodiments of the device, one a padded resilient sheet curved to provide the support surface and a second in the form of an inflatable pillow.

A FIFTH EXAMPLE, U.S. Pat. No. 4,617,691 to Monti, et al. teaches a generally rectangular or other suitably shaped support pillow adapted to be removably secured around a user's neck. A single elongated wedge-shaped pillow segment is provided with fasteners for joining one end to the other. The wedge shape gives increased lateral support to the user's neck and head. Worn with the fasteners under the user's chin, it gives increased head and neck support whereas if it is worn with the fasteners behind the user's head, it gives increased chin and head support. A three-piece version is also provided and the various pillow segments may be of various sizes. A laminate may be applied to render the support pillow bacteria proof, flame retardant and waterproof while allowing heat and perspiration to escape. A spring-like closure version is also shown.

A SIXTH EXAMPLE, U.S. Pat. No. 4,710,991 to Wilmore, et al. teaches a pillow for a headrest having a pair of opposing lateral head support pads each having inner opposing and top surfaces for supporting the head. Alternatively, the pillow may be used for supporting and immobilizing the cervical spine of a person in a supine position. The pillow preferably includes three layers of plastic film sealed together about their periphery forming a closed upper chamber and a closed lower chamber. Two baffles preferably extend the width of the lower chamber thereby forming longitudinally oriented outer, intermediate and inner lower subchambers. All chambers and subchambers are appropriately filled with a viscous gel.

A SEVENTH, U.S. Pat. No. 5,029,577 to Sarkozi teaches a soft neck support collar is disclosed comprising two offset and attached, tubular ring elements, each element hooking together at their respective ends. Both ring elements contain a soft fill material such as nylon, cotton, polyester, acrylics, foam, foam chips, etc. The combined effect of the fill material together with the tubular configuration, enables the neck to adjust for lateral forward and backward forces during movement. The upper ring element is tapered at each end, so that when these ends are joined together, a space is formed into which the chin can fit, thereby maintaining the neck in a neutral position, and preventing hyperextension. The lower ring element is hooked together at each end, and the rings are offset to enable the lower ring to close at the back of the neck, approximately opposite from the closure of the upper ring element. Hence, the lower ring element functions as a continuous, uniform tubular-shaped ring, which does not interfere with movement of the chin. Thus, in the closed configuration, the neck support collar allows for neutral positioning of the chin and neck, and restricts neck mobility.

AN EIGHTH EXAMPLE, U.S. Pat. No. 5,060,637 to Schmid, et al. teaches a disposable cervical collar having an elongated unitary body formed from plastic core board or similar cellular material, the collar having a frontal section provided with a chin receiving opening, including a chin supporting flap and optionally a chin strap, with a throat opening underlying the chin opening, and a rear section which is slotted at spaced intervals for bending to conform to the wearer's neck, the rear section having a plastic strap adapted to be adhesively secured to the frontal section to secure the collar in place.

A NINTH EXAMPLE, U.S. Pat. No. 5,303,890 to Carruth teaches a chin rest is arranged to include a housing having a top wall to include a pad member mounted therein. The housing includes first and second leg tubes mounted to opposed ends of the housing, that in turn include first and second respective extension legs that are provided with support pads to position the organization relative to an underlying support surface permitting an individual to rest the chin thereon during reading and other events when the individual is in the supine position.

A TENTH EXAMPLE, U.S. Pat. No. 5,860,177 to Jung teaches an adjustable travel pillow unit having a pillow outer shell, a support frame within the shell and an adjustment mechanism. The mechanism allows an arm to extend or retract in alignment with a plane and is movable itself in alignment with a plane perpendicular to the first mentioned plane.

AN ELEVENTH EXAMPLE, U.S. Pat. No. 6,122,784 to Hurwitz teaches a travel headrest, having first and second head cushions each having a top portion, a bottom portion and opposite sides and being elongate from the top portion to the bottom portion. The second head cushion portion includes an intermediate portion between its top and bottom portions and a flexible connecting portion interconnects the first head cushion and the intermediate portion, the top and bottom portions of the second head cushion projecting upwardly and downwardly, respectively, from the intermediate portion and from the connecting portion. The cushions may be stuffed or inflatable.

A TWELFTH EXAMPLE, U.S. Pat. No. 6,231,535 to Mainiero, et al. teaches a support for maintaining the head of a wearer erect when the wearer is in a sitting position. The support includes a body for maintaining the head of the wearer erect when the wearer is in the sitting position, and a strap that extends from the body for engaging around the neck of the wearer. The body is rigid and defined by a plurality of arcuately-shaped surfaces so configured so as to accommodate for the clavicle, the chin, the upper chest, the neck of the wearer and a knot of a tie if worn by the wearer.

A THIRTEENTH EXAMPLE, U.S. Pat. No. 6,625,829 to Zell teaches a chin support pillow for supporting a person's head in an upright position while sitting. The pillow includes an elongate cushioning body with a cloth covered foam core and a zippered cloth outer cover. A flexible strap extends from one end of the body and is connectable to the other end of the body using interconnecting patches of hook and loop fastener material to bend the body at the center into a V-shaped configuration. The center of the body in such a V-shaped configuration fits between the chin and the upper chest region of the person with the first and second legs extending along and fitting between opposite lower edges of the jaw and the respective shoulder regions to support the person's head. The flexible member extends around the back of the person's neck and is of adjustable length to custom fit the person wearing the chin support pillow.

OBJECTS AND SUMMARY OF THE INVENTION

The principal object of the present invention is to provide a travel pillow which is of a non-inflatable or inflatable design that supports the human head, while sleeping in the vertical or near-vertical position in a way that maintains a healthy natural curvature of the cervical vertebrae relative to the thoracic vertebrae and occipital bone and does not suffer the disadvantages associated with conventional travel pillows.

An object of the present invention is to provide a travel pillow, which prevents forward and lateral drooping of the head while sleeping in a vertical or near-vertical position.

Another object of the present invention is to provide a travel pillow, which does not forwardly displace the cervical vertebrae, while sleeping in a vertical or near-vertical position to preserve the health of the human spine.

Yet another object of the present invention is to provide a travel pillow, which configures its head supports forward of the shoulder line to hold the resting head in its most comfortable tilted position while sleeping in a vertical or near-vertical position.

An additional object of the present invention is to provide a travel pillow in which shapes the head supports are shaped to arrest forward motion and lateral motion while sleeping in a vertical or near-vertical position.

Still an additional object of the present invention is to provide a travel pillow, which prevents undesired slippage or movement while sleeping in a vertical or near-vertical position.

Still yet an additional object of the present invention is a travel pillow, which is simple in construction, easy to use and relatively inexpensive to manufacture.

A further object of the present invention is to provide a travel pillow, which is versatile in that it has a compact configuration, which allows for conventional carriage in a standard size luggage.

In summary, the main object of the present invention is to provide an improved travel pillow, which is versatile, easy to manufacture, secure in its use, comfortable and adaptable to the needs of the user.

BRIEF DESCRIPTION OF DRAWINGS

The above and the other objects and advantages and novel features of the present invention will become apparent from the following detailed description of the preferred embodiment of the invention illustrated in the accompanied drawings, wherein.

DETAILED DESCRIPTION OF THE INVENTION

Figure 1:
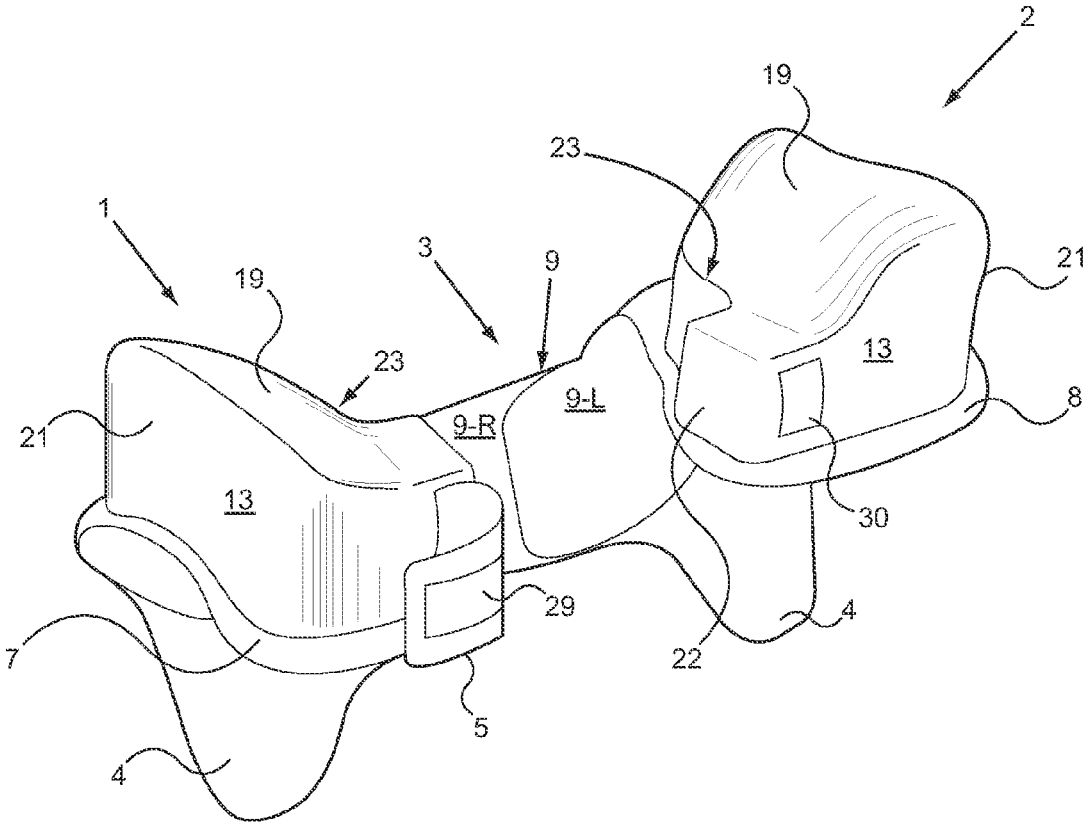
FIG. 1 is a perspective view of the sleeping pillow of the present invention.
Figure 2:
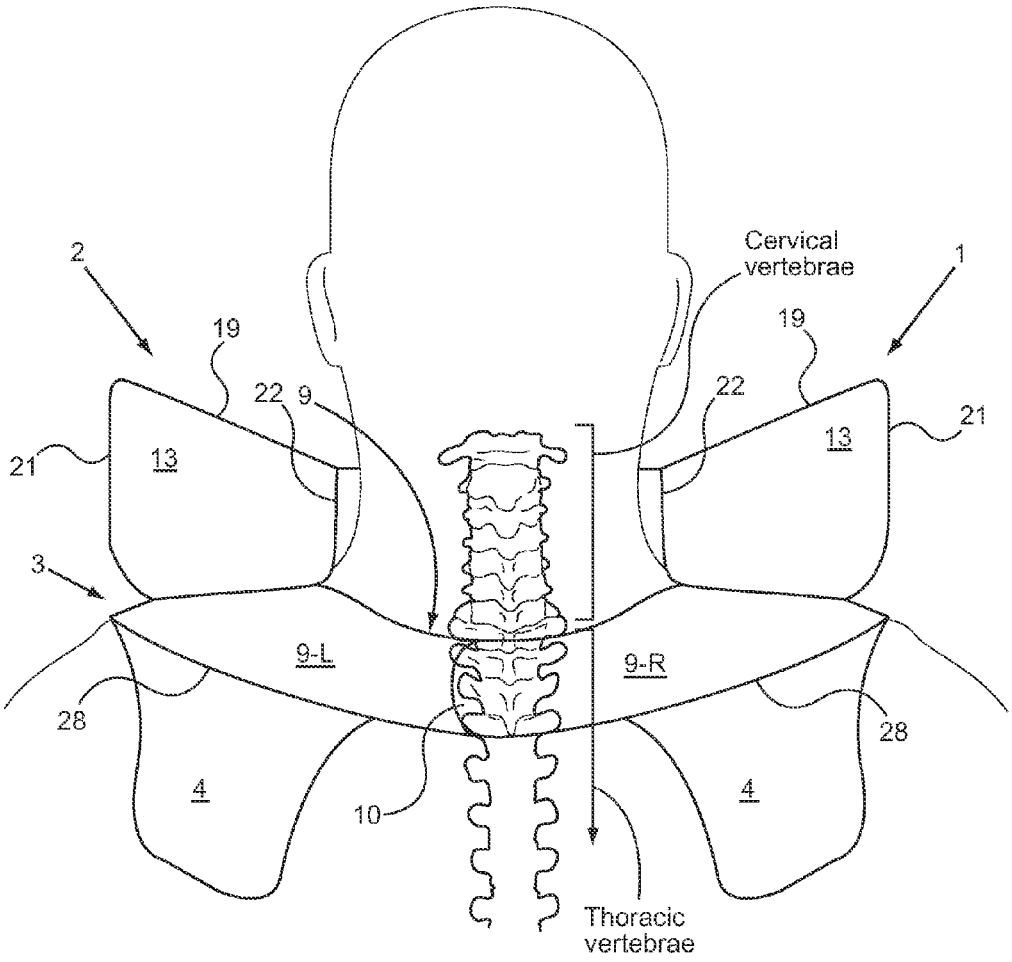
FIG. 2 is a rear elevational view of the sleeping pillow of the present invention shown in FIG. 1.

As best shown in FIG. 1, the travel pillow of the present invention comprises five (5) parts designated right head-support 1 for supporting the right side of the head, left head-support 2 for supporting the left side of the head, base 3 for supporting and positioning both the right head-support 1 and left head-support 2 forward of the right shoulder and left shoulder, respectively, back anchor 4, as better shown in FIG. 2, for deterring unwanted movement, such as rotation, pitching, etc. of the travel pillow, and a securing collar 5 for holding the travel pillow on the shoulders while sleeping in a vertical or near-vertical reclined position.

Figure 3:
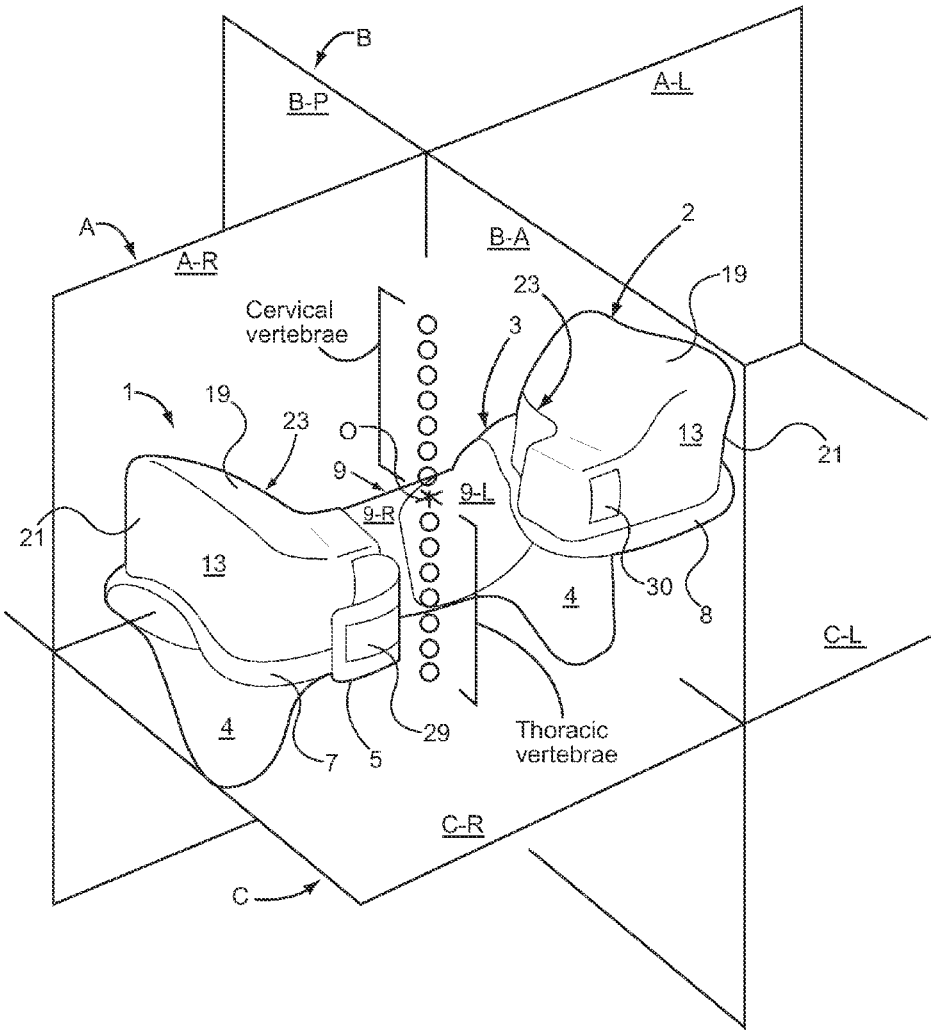
FIG. 3 is a perspective view of the sleeping pillow shown in FIG. 1 relative to a three-dimensional planer coordinates system used to reference the present invention.

Each of the designated parts of the travel pillow will be described in reference to, as best shown in FIG. 3, a three-dimensional planer system composed of a frontal plane A, which passes laterally through the shoulder line of the human body dividing it into an anterior portion and posterior portion, a median plane B, which bisects the body vertically through the spine into a right side and left side and lastly an axial plane C which intersects with frontal plane A and median plane B at the base of the cervical spine to establish an origin O and the three dimensional planer system in which the frontal plane A, median plane B, and axial plane C are at right angles with respect to each other. The three-dimensional planer system can be further deconstructed, comprising a right-frontal plane A-R, a left-frontal plane A-L, an anterior median plane B-A, a posterior median plane B-P, a right-axial plane C-R, and a left-axial plane C-L.

Figure 4:
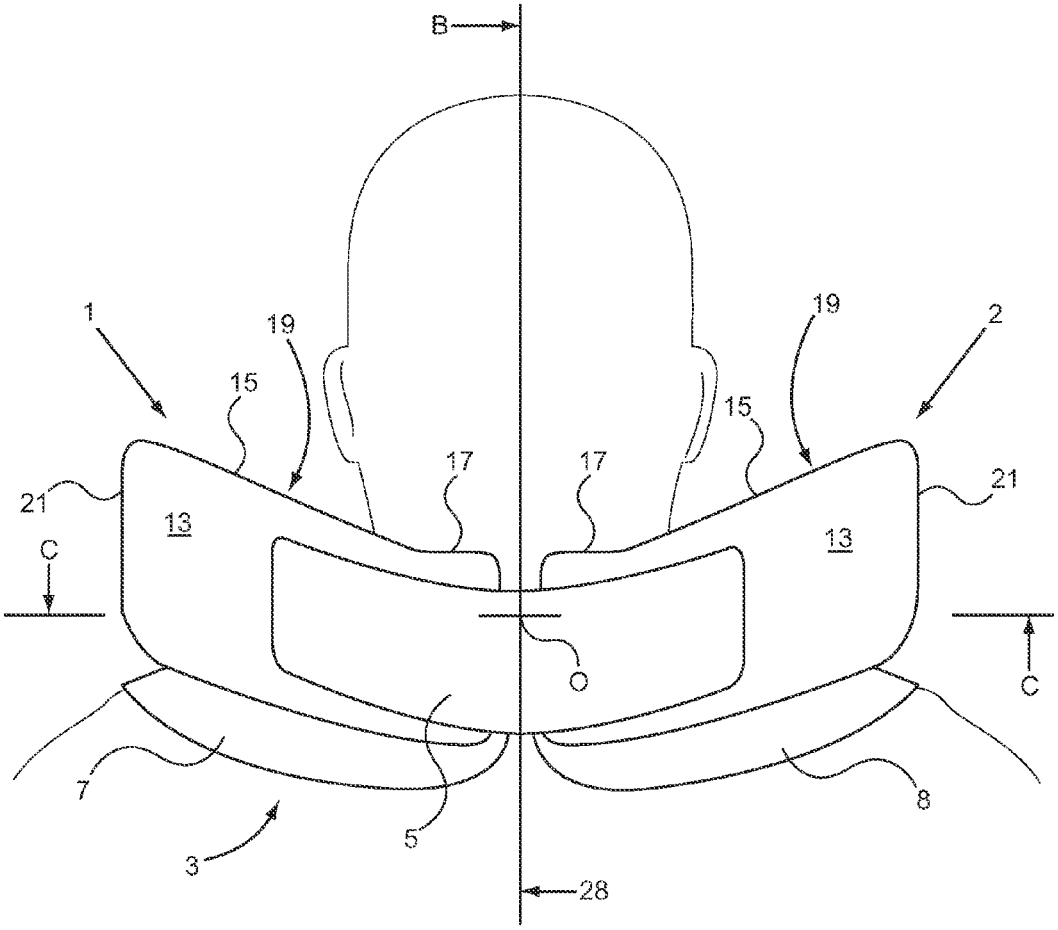
FIG. 4 is a front elevational view of the sleeping pillow of the present invention shown in FIG. 1.
Figure 5:
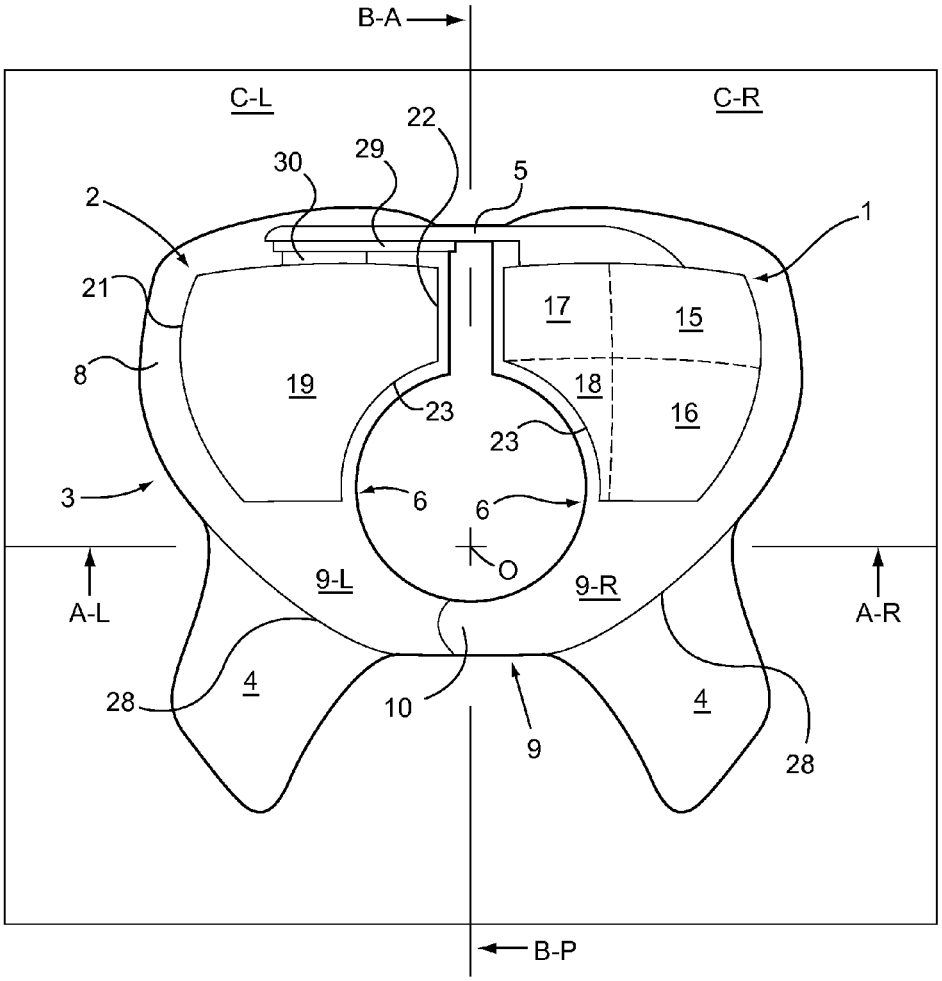
FIG. 5 is a top elevational view of the sleeping pillow of the present invention shown in FIG. 1.

As best shown in FIGS. 4 and 5, the right head-pillow 1 and left head-pillow 2 are symmetrical opposites in shape, size and function. Furthermore as illustrated in FIG. 5, the right head-support 1 is oriented forward of the right-frontal plane A-R in the right-axial plane C-R and the left head-support 2 is oriented forward of the left-frontal plane A-L in the left-axial plane C-L.

Figure 6:
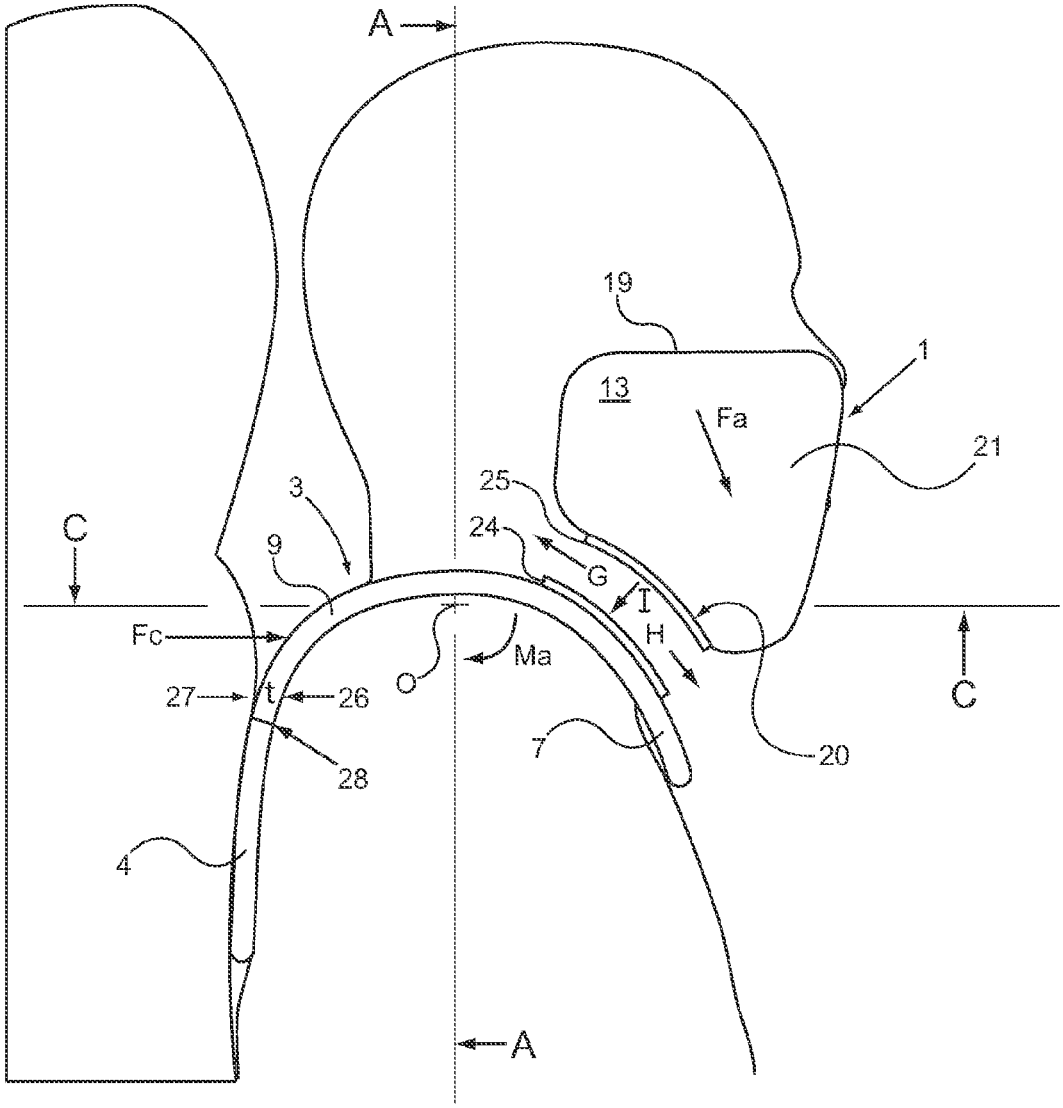
FIG. 6 is a right elevational side view of the sleeping pillow of the present invention shown in FIG. 1.

As best shown in FIG. 6, the base 3 laterally contours the right shoulder from its posterior to its anterior to rest on the right shoulder along right frontal plane A-R, as best shown in FIG. 5, and also laterally contours the left shoulder from its posterior to its anterior rests on the left shoulder along left frontal plane A-L. As best shown in FIG. 4, the contours for the right shoulder and left shoulder also are slopes downward, relative to the axial plane C, along the shoulder line and frontal plane A, starting near the base of the cervical spine and origin O and traversing outward to the outer shoulder to form fit to the natural curvature and slope of the human shoulder, as best shown in FIG. 6. The base 3 consists of a flexible material for contouring to the shape of the shoulder along the frontal plane A.

Figure 7:
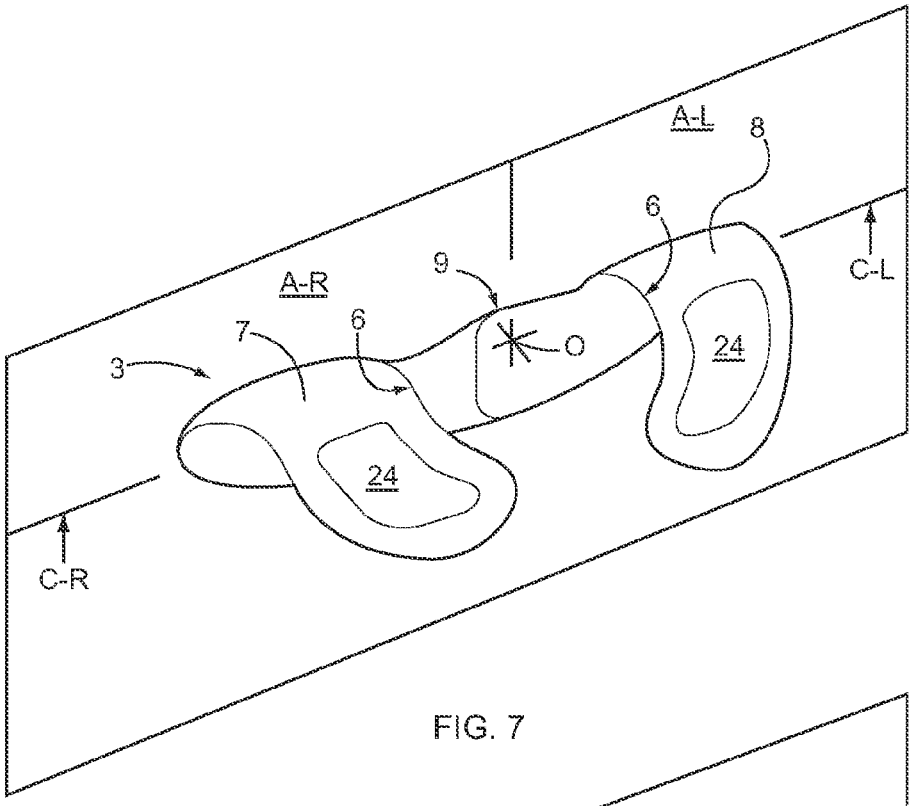
FIG. 7 is a partial perspective view of the base component of the present invention shown in FIG. 1.
Figure 8:
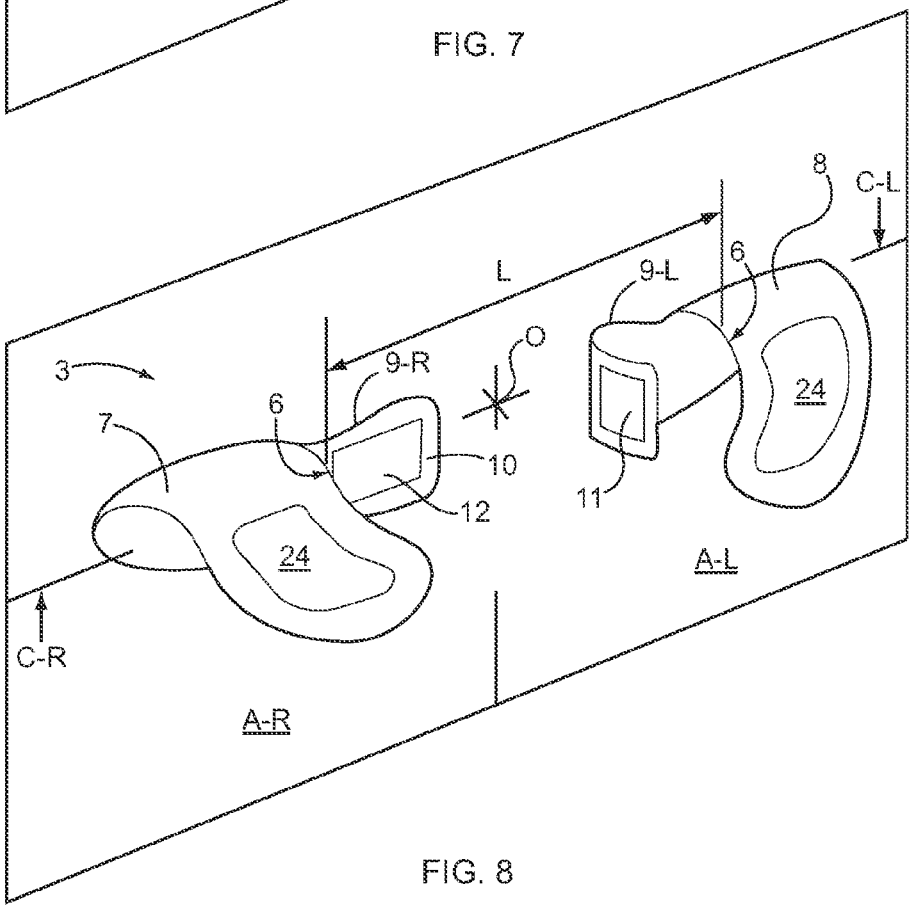
FIG. 8 is a deconstructed perspective view of base component shown in FIG. 7 of the present invention shown in FIG. 1.

As best shown in FIG. 5, base 3 has an inner perimeter 6. As best shown in FIG. 7, base 3 deconstructs further to comprise a right-base section 7, a left-base section 8 and rear-base section 9. The rear-base section 9 demarcates with the right-base section 7 along the right-frontal plane A-R and demarcates with the left-based section 8 along the left-frontal plane A-L. Moreover, as best shown in FIG. 8, the rear-base section 9 further deconstructs to a right rear-base section 9-R and a left rear-base section 9-L. The right rear-base section 9-R includes an overlapping tab 10 for connecting the right rear-base section 9-R to the left rear-base section 9-L to form an integrated rear-base section 9. The left rear-base section 9-L is outfitted with a receiving fastening means 11. The tab 10 is outfitted with a fastening mechanism 12, which has a laterally wide connection area for permitting different connection points to be made with the receiving fastening means 11 for changing the lateral distance L between the inner-perimeter 6 of the base 3.

Figure 9:
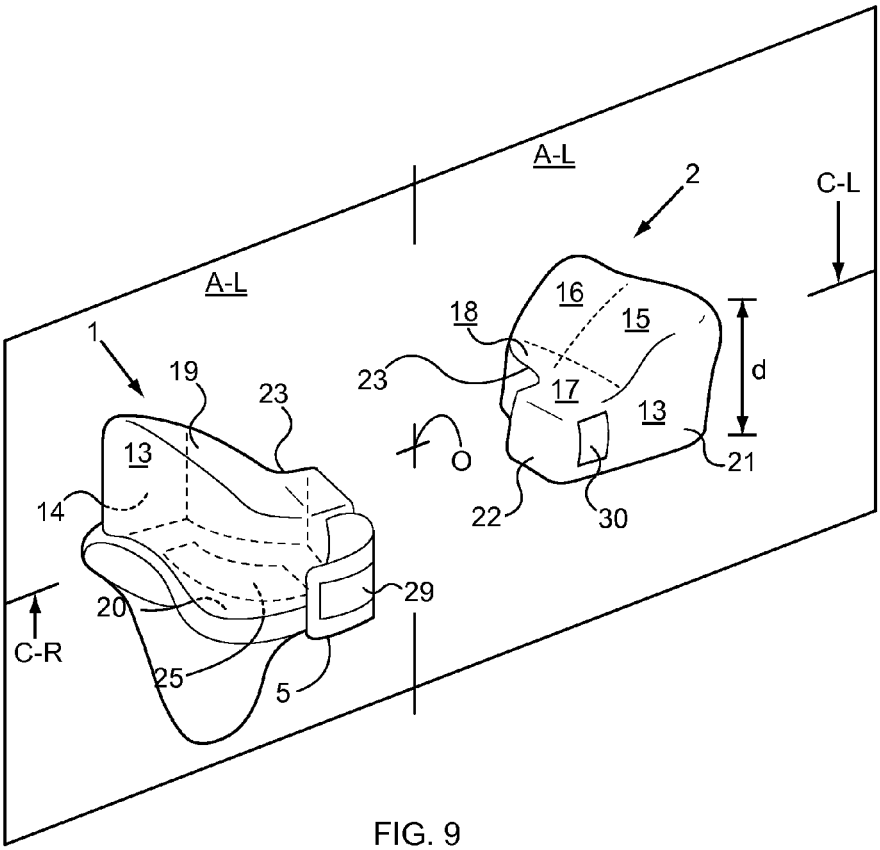
FIG. 9 is a partial perspective view of the right-head support and left-head support of the present invention shown in FIG. 1.

As best shown in FIG. 9, the right head-support 1 and left head-support 2 comprises of an enclosed outer-casing 13 constructed of a soft pliable material for engaging the human skin and a cavity 14 for housing a filler material for expanding and maintaining the shape of outer-casing 13. Optionally, the outer-casing 13 can be engineered to create an "airtight" cavity 14 to serve as an internal bladder allowing air to replace the aforementioned filler material as the expander of outer-casing 13.

The outer-casing 13, of the right head-support 1 and left head-support 2, respectively, has an overall rectangular cylinder shape; it's horizontal cross sectional area is depicted in quadrant areas: forward-outer quadrant area 15, rear-outer quadrant area 16, forward-inner quadrant area 17, and rear-inner quadrant area 18. The outer-casing 13 is comprised of three joined surfaces made up of a top surface 19, bottom surface 20 and a continuous vertical surface, which comprises an outer vertical surface 21 and an inner vertical surface 22 to create the aforementioned cavity 14. The outer vertical surface 21 and the inner vertical surface 22 demarcates at the boundary between the forward-outer quadrant area 15 and forward-inner quadrant area 17 and again at the boundary between the rear-outer quadrant area 16 and rear-inner quadrant area 18. It should be established that the multiple of the cross sectional area for a given quadrant and the vertical distance d between its top surface 19 and bottom surface 20 yields the volume for that given quadrant.

As best shown in FIGS. 9 and 5, the volume of the rear-inner quadrant area 18 has mostly been removed to create a concave contour 23 in the rectangular cylinder for the purpose of accommodating the presence of the neck. This allows the front-inner quadrant area 17 to curve around the front of the neck and underneath the jaw and chin of the head to cradle the head as illustrated in FIG. 4.

As best shown in FIGS. 4 and 9, the front-inner quadrant area 17 of the top surface 19, relative to the axial plane C, is basically horizontal in orientation. Relative to the axial plane C, the forward-outer quadrant area 15 and rear-outer quadrant area 16 of the top surface 19 are angled inward towards the origin O to enable more surface area to be vertically directed towards the face and head for providing unprecedented upright head support and stability. The top surface 19 is pliable in construction to permit it to conform to the shape of the user's face.

As best shown in FIG. 6, the head-pillow's bottom surface 20 as well as the right-base section 7 and left-base section 8 conform to the shape of the outer upper chest and frontal shoulder region around the clavicle bone, effectively drooping the frontal region of the rectangular cylindrical shaped head support downward over the front of the shoulder. This permits the bottom surface 16 to uniformly connect, in a stacked configuration, with base 3 forward of the shoulder line and frontal plane A.

Figure 10:
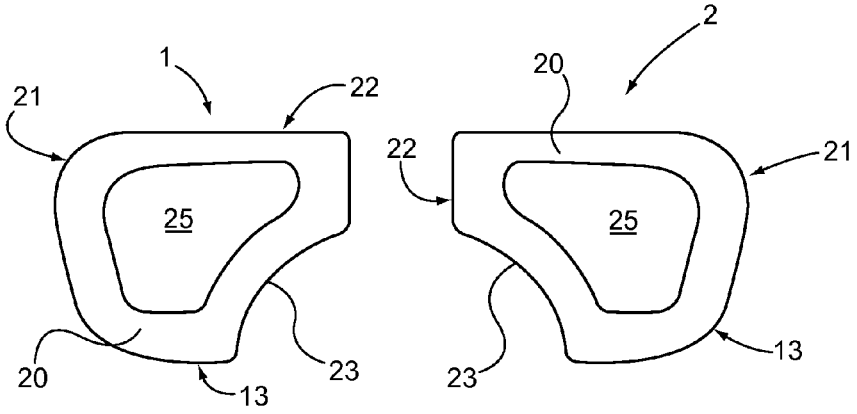
FIG. 10 is a partial bottom elevational view of right-head support and left-head support shown in FIG. 9 of the present invention shown in FIG. 1.

As best shown in FIGS. 8 and 6, the right-base section 7 and the left-base section 8 are outfitted with a receiving fastening mechanism 24. As best shown in FIGS. 10 and 6, the bottom surface 20 of the right head-support 1 and left head-support 2 are outfitted with a fastening mechanism 25. As best shown in FIG. 6, when fastening mechanism 25 is detached from the receiving fastening mechanism 24, the position of the right head-support 1 and left head-support 2 on the base 3 can be changed by moving the fastening mechanism 25 along the receiving mechanism 24, as illustrated by arrow G and arrow H. The orientations of the right head-support 1 and left head-support 2 are then set relative to the right-base section 7 and left-base section 8, respectively, by pressing the fastening mechanism 25 onto the receiving mechanism 24, as illustrated by arrow I.

The rear-base section 9 of base 3 is designed to meet two design objectives. First, as best shown in FIG. 2, the rear-base section 9 rests across the rear portion of the shoulder and upper back at or just below the eighth vertebra (i.e., the first thoracic vertebra) to avoid the neck and cervical vertebrae and connect the right-base section 7 and its vertically attached right-head support 1 with the left-base section 8 and its vertically attached left-head support 2 into an integrated unit, which includes the securing collar 5 for resting on the shoulders in a secure and stable manner. This configuration allows the surface area that comprises the rear-base section 9 to distribute across the upper back, as best shown in FIG. 6, the force Fc that counteracts and balances the forces Fa acting on the right head-support 1 and left head-support 2 and their moments Ma generated relative to the origin O. The present invention moves the force Fc below the cervical vertebrae thereby preventing the force Fc from pulling the neck and head forward as would be the case with the current state of the art.

Second, the rear-base section 9 has an inner surface 26, which, when in operational engagement, makes contact with the upper back and an outer surface 27. The distance between these two surfaces defines its cross sectional or profile thickness t. The profile thickness t is very thin by design, so as to minimize forward displacement of the human body from its resting surface caused by the thickness t of the rear-base section 9 while in operation. The almost negligible forward displacement of the body from the back-rest of a seat, for example, due to the thin design approach of the rear-base section 9 and because of its position along the upper back and not the neck produces no forward displacement of the neck or head.

The back-anchor 4 is constructed of a pliable material capable of producing friction when pressed between two surfaces. As best shown in FIGS. 2 and 6, the back-anchor 4 fastens at the rear of the base 3 along seam 28. The back anchor 4 is designed to freely hang down over the upper and outer region of the back to, in part, envelope the scapula. When pressed by the weight of an upper torso against another surface, for instance the backrest of a seat, the back anchor 4 will form fit to the shape of the upper back and backrest to create resistance across the surface area of the back anchor 4 to hold the travel pillow onto the shoulders of the user and thereby resist slippage and rotation around the shoulders when the head changes position while sleeping. It should be noted that in general the under surface material of base 3 is capable of producing frictional force to help resist slippage of the base 3 over the shoulders when forces act on the present invention.

The securing collar 5, as best shown in FIG. 1, permanently connects to the right head-support 1 and temporarily connects to the left head-support 2. There is no design advantage to this configuration; therefore, the configuration can be swapped. The stabilizing collar 5 is outfitted with a fastening mechanism 29 for connecting to a receiving fastening mechanism 30 attached to the left head-support 2. The connection area of the fastening mechanism 29 is laterally wide to allow the receiving mechanism 29 to be connected at different points along its width to the receiving fastening mechanism 30 for selectively adjusting the lateral distance between right head-support 1 and left head-support 2. In FIGS. 4 and 5 the securing collar 5 is shown engaged and set to a selected lateral distance between right head-support 1 and left head-support 2 to secure the travel pillow on the shoulder of the user while sleeping in the vertical and near-vertical reclined position.

The travel pillow of the present invention is designed such that right head-support 1 or left head-support 2 can be folded over the other for storage in a carrying case.

Use and Operation

In order to use the travel pillow of the present invention, the user first removes the non-inflatable version of the travel pillow from its carrying case. The user then unfolds the right head-support 1 from the left head support 2 such that they are adjacent to each other. To ready the inflatable version of the travel pillow of the present invention, the user must first inflate "airtight" cavity 14 using an inflation mechanism.

The user then places the right head-support 1 and left head-support 2 around the neck and onto the shoulders from behind the neck making certain that the rear-base section 9 rests across the upper back and the back-anchor 4 hangs unencumbered down along the back.

If the user feels that the travel pillow is not fitting snugly or is uncomfortable around the neck, the user can adjust the inner-perimeter 6 of the base 3 by detaching tab 10 and its fastening mechanism 12 from the receiving fastening mechanism 11. After which, viewing the travel pillow from the rear, the user can increase the circumference of the inner-perimeter 6 of the base 3 by moving the tab 10 to the right along the width of the receiving fastening mechanism 11 or decrease the circumference of the inner-perimeter 6 by moving the tab 10 towards the left. The user then re-establishes the connection by pressing the fastening mechanism 12 to the receiving fastening mechanism 11.

If the positioning of the right head-support 1 and left head-support 2 is not comfortable for the user. The user can disconnect the right head-support 1 and left head-support 2 by detaching the fastening mechanism 25 from the receiving fastening mechanism 24. After which, the user can move either of the head-supports—i.e., right head-support 1 and left head-support 2—upward towards the head or downward away from the head to a desired position. The user then reattaches by pressing the fastening mechanism 25 to the receiving mechanism 24.

The user then secures the right head-support 1 and left head-support 2 on the shoulders by first overlapping the fastening mechanism 29 of the securing collar 5 with the receiving fastening mechanism 30 of the left head-support 2 so that the right head-support 1 and left head-support 2 rest against the right side and left side of the head, respectively. After which, the user secures the selected overlapping configuration by connecting fastening mechanism 29 to the receiving mechanism 30.

With the back anchor 4 freely hanging over the upper back, the user then lays back onto the headrest-equipped seat. Since sleeping pillow of the present invention does not have the traditional rear section found on conventional pillow designs, the cervical spine will not be forced forward, away from its neutral position, and therefore, the head is free to naturally rest against the headrest. The weight of the upper torso will press the back-anchor 4 against the backrest causing the back-anchor 4 to create a resistive force between the backrest and user's upper back to resist slippage and rotation and thus stabilize the sleeping pillow of the present invention while sleeping.

What is claimed is:

1. A pillow for supporting a head during traveling, comprising: a right head support comprised of a first outer casing enclosing a first closed cavity within the right head support, the right head support configured to support the head while resting on an upper chest of a user, the first outer casing including a first top surface and a first vertical surface, the first top surface of the first outer casing comprising: a first horizontal surface configured to support a chin of the head, the first horizontal surface being horizontal in a frontal view of the pillow; and a first head support surface sloping downward, in the frontal view of the pillow, towards the first horizontal surface and configured to laterally stabilize the head, the first head support surface and the first vertical surface being at opposite sides of the first horizontal surface in the frontal view of the pillow; a left head support comprised of a second outer casing separate from the first outer casing and enclosing a second closed cavity within the left head support that is separate from the first closed cavity, the left head support configured to support the head while resting on the upper chest of the user, the second outer casing including a second top surface and a second vertical surface facing the first vertical surface in the frontal view of the pillow, the second top surface of the second outer casing comprising: a second horizontal surface configured to support the chin of the head, the second horizontal surface being horizontal in the frontal view of the pillow; and a second head support surface sloping downward, in the frontal view of the pillow, towards the second horizontal surface and configured to laterally stabilize the head, the second head support surface and the second vertical surface being at opposite sides of the second horizontal surface in the frontal view of the pillow; and a flexible rear section configured to traverse across, rest against and flexibly contour to a posterior of the user while the right head support is supporting the head and the left head support is supporting the head, the rear section having a first end region connected to the right head support and a second end region connected to the left head support.

2. The pillow of claim 1, wherein the flexible rear section includes a first surface configured to rest against the posterior of the user and a second surface configured to face away from the posterior of the user, a distance between the first surface and the second surface forming a thin cross section having a thickness that causes substantially no forward displacement of the user relative to a seat when the rear section is pressed between the user and the seat.

3. The pillow of claim 1, wherein the flexible rear section is detachably connected to at least one of the right head support and the left head support.

4. The pillow of claim 1, wherein the flexible rear section is detachably connected to both the right head support and the left head support.

5. The pillow of claim 1, wherein the flexible rear section is adjustably connected to at least one of the right head support and the left head support to adjust a position of the at least one of the right head support and the left head support relative to the flexible rear section.

6. The pillow of claim 1, wherein the flexible rear section is adjustably connected to both the right head support and the left head support to adjust a position of the right head support and the left head support relative to the rear section.

7. The pillow of claim 1, wherein the flexible rear section includes a right rear section and a left rear section, the right rear section being adjustably connected to the left rear section to adjust a lateral distance between the right rear section and the left rear section.

8. The pillow of claim 1, further comprising:

a frontal securing collar connected to both the right head support and the left head support.

9. The pillow of claim 8, wherein the frontal securing collar is detachably connected to at least one of the right head support and the left head support.

10. The pillow of claim 9, wherein the frontal securing collar is fixedly connected to the other one of the right head support and the left head support.

11. The pillow of claim 8, wherein the frontal securing collar is adjustably connected to at least one of the right head support and the left head support to adjust a lateral distance between the right head support and the left head support.

12. The pillow of claim 8, wherein the frontal securing collar is connected to a first frontal surface of the right head support, and the frontal securing section is connected to a second frontal surface of the left head support.

13. The pillow of claim 8, wherein the frontal securing collar extends across a gap between the right head support and the left head support.

14. The pillow of claim 1, wherein the right head support and left head support are configured to be positioned completely in front of a frontal plane when supporting the head, the frontal plane passing vertically through a midpoint of a shoulder line of the user and separating an anterior of the user from the posterior of the user.

15. The pillow of claim 1, wherein the first top surface of the first outer casing is configured to conform to a face, and the second top surface of the second outer casing is configured to conform to the face.

16. The pillow of claim 1, wherein the right head support comprises a concave neck contour region, and the left head support comprises a concave neck contour region.

17. The pillow of claim 1, wherein the first closed cavity within the right head support and the second closed cavity within the left head support are at least one of inflatable or filled with filler material.

18. The pillow of claim 1, wherein the right head support is connected to the flexible rear section with a first fastening mechanism and the left head support is connected to the flexible rear section with a second fastening mechanism.

19. The pillow of claim 1, wherein the first horizontal surface and the second horizontal surface are configured to support the chin from underneath the chin.

20. The pillow of claim 8, wherein the first vertical surface and the second vertical surface face each other, and the frontal securing collar extends across a gap between the first vertical surface and the second vertical surface.

21. The pillow of claim 1, wherein in the frontal view of the pillow, the left and right head supports are closer to a viewing perspective for the frontal view than the flexible rear section.

* * * * *